US007625096B2

(12) United States Patent
Ginn et al.

(10) Patent No.: US 7,625,096 B2
(45) Date of Patent: Dec. 1, 2009

(54) PLATFORM EDGE INDICATOR

(76) Inventors: Ellis Charles Ginn, 'Fermoys', Splaynes Green, Fletching East Sussex TN22 3TE (GB); Gary James Crawford, 4 Cooden Ledge, St Leonards on Sea TN38 8 ET (GB)

( * ) Notice: Subject to any disclaimer, the term of this patent is extended or adjusted under 35 U.S.C. 154(b) by 0 days.

(21) Appl. No.: 11/807,256

(22) Filed: May 25, 2007

(65) Prior Publication Data

US 2008/0264326 A1 Oct. 30, 2008

(30) Foreign Application Priority Data

Apr. 26, 2007 (GB) ..... 0708117.7

(51) Int. Cl.
*F21S 8/00* (2006.01)

(52) U.S. Cl. ..... 362/146; 362/153; 116/205

(58) Field of Classification Search ..... 362/84, 362/153, 153.1, 146, 34; 116/205
See application file for complete search history.

(56) References Cited

U.S. PATENT DOCUMENTS

| | | | | | |
|---|---|---|---|---|---|
| 2,696,027 | A * | 12/1954 | Ryland | 52/182 |
| 4,394,714 | A * | 7/1983 | Rote | 362/576 |
| 5,775,016 | A * | 7/1998 | Chien | 40/544 |
| 5,961,072 | A * | 10/1999 | Bodle | 244/118.5 |
| 7,367,699 | B2 * | 5/2008 | Lierow | 362/471 |

* cited by examiner

*Primary Examiner*—John A Ward
(74) *Attorney, Agent, or Firm*—Fay Sharpe LLP

(57) ABSTRACT

An elongate strip for indicating a platform edge includes a base for resting on a platform; a back and a further surface. The arrangement is such that with the device resting on a platform, the further surface takes the place of the platform surface and includes an indicator to indicate an edge of the platform.

21 Claims, 7 Drawing Sheets

PLATFORM EDGE INDICATOR

The present invention relates to an indicator for an edge, in particular an indicator for an edge of a theatre stage.

Theatres, lecture halls, school halls and other establishments generally include a stage on which individuals or groups of people may perform, present displays or provide lectures, talks and other such for the entertainment or edification of the populace. The stage surface is usually elevated above the audience to provide the best possible view of any production for all members of this audience. In addition to this elevation such stages may also be slightly inclined, such that a portion of the stage adjacent the audience is lower than a portion of the stage furthest from the audience, rendering the whole stage visible to all.

A difficulty with such an arrangement is that any stage must be prepared for a performance, and during such preparation it is necessary for many different people to access the stage to carry out a variety of tasks. Such people will be concerned with the particular tasks for which they are responsible, and are likely to move all around the stage to complete such tasks, including the edge of the stage.

In addition, during a performance, actors, singers, dancers or other such occupy the stage and it is often desirable for them to utilise the whole stage area, including the area adjacent the stage edge. Talks and lectures also tend to require the orator to be positioned adjacent the stage edge.

During a performance the stage is very brightly lit from a lighting array generally positioned above the stage, rendering the stage area bright and the auditorium shadowy at best. The edge of the stage is difficult to see under those circumstances, particularly when a performer is preoccupied with his performance, and often, for example during pantomime, actors wear cumbersome costumes which impair their ability to recognise the proximity of the stage edge.

In the absence of a barrier, the danger of an accidental fall off the edge of the stage is ever present.

A further difficulty is that objects placed on the stage, such as props during a performance, or tools and suchlike assisting in the preparation of the theatre for a performance, may roll or slide along the incline of the stage and fall off the edge.

It is common for theatres to include an area for musicians to provide musical accompaniment to a performance, and such areas are often provided adjacent to but below not only the surface of the stage but also below the level of the audience in, for example, an 'orchestra pit'. The audience may thereby enjoy the music without being distracted from the performance by a view of the musicians.

Any item or person falling off the stage may fall down to the level of the audience, or may fall down into the orchestra pit and such falls may result in damage to not only the item or person falling but also to anyone or anything underneath.

In earlier times lighting used for performances was positioned at a stage edge, and such lightning arrangements provided a barrier of sorts. As lighting has become more sophisticated it has been moved to a position above the stage and at the present time the edge of a stage is conventionally indicated by means of a white line painted adjacent its edge. The advantage of indicating the edge of the stage by means of a painted white line is that the line is clearly visible to those present on the stage itself, and is less clearly visible to the majority of the audience. A disadvantage of this method is that it relies on individuals to attend to the warning embodied by the white line to protect themselves or props and tools. Busy or distracted people can miss this warning with inconvenient or tragic results.

A further method that has been suggested for overcoming the above mentioned problems is to fire a laser beam across the stage along the edge, but this has the disadvantage that it may be visible to, and distracting for, the audience during a performance and may also only be suitable for stages with a straight edge, not stages with a curved edge.

According to the present invention these problems are overcome by a device providing an indication of a stage edge, the indicator assisting in preventing people inadvertently falling, or objects rolling, sliding or slipping, off a stage.

The present invention provides, according to a first aspect, an elongate strip for indicating a platform edge comprising a base for resting on a platform, a back, and a further surface, the arrangement being such that with the device resting on a platform, said further surface takes the place of the platform surface and includes an indicator to indicate said platform edge.

Preferably the strip is wedge-shaped.

Preferably the strip includes attachment means for attaching the device to a platform.

According to one embodiment the indicator comprises reflecting means, which may be situated on the further surface. Alternatively, or additionally, the indicator may comprise light emitting means, such as a fluorescent strip, or a photo luminescent strip or other suitable means, and such means may also be situated on the further surface.

Preferably the device further includes anchoring means. Still more preferably the anchoring means includes a grove in a surface of the strip, a tube running through the device, or hooks attached to the back of the strip. The anchoring means may be suitable for anchoring cabling. The strip may further include openings, such that for example cabling anchored by the anchoring means may access the further surface.

Preferably any grooves are shaped to releasably retain such cabling within said groove.

Still more preferably the further surface of the device is sloped, ridged or stepped.

Preferably the reflecting means and the light emitting means includes means to restrict the reflected and emitted light such that it shines only onto the platform.

Preferably the further surface includes means to attach a barrier.

Preferably the attachment means is a detachable attachment means.

It is contemplated that the back is dimensioned such that it obscures little, if any, of the platform surface, as seen from the auditorium. In particular, the back may be dimensioned such that, with the indicator positioned on a sloped platform, the top surface of the device is below the portion of the platform remote from the device.

Preferred embodiments of the invention will now be described by way of example only and with reference to the accompanying drawings in which.

Figure 2:
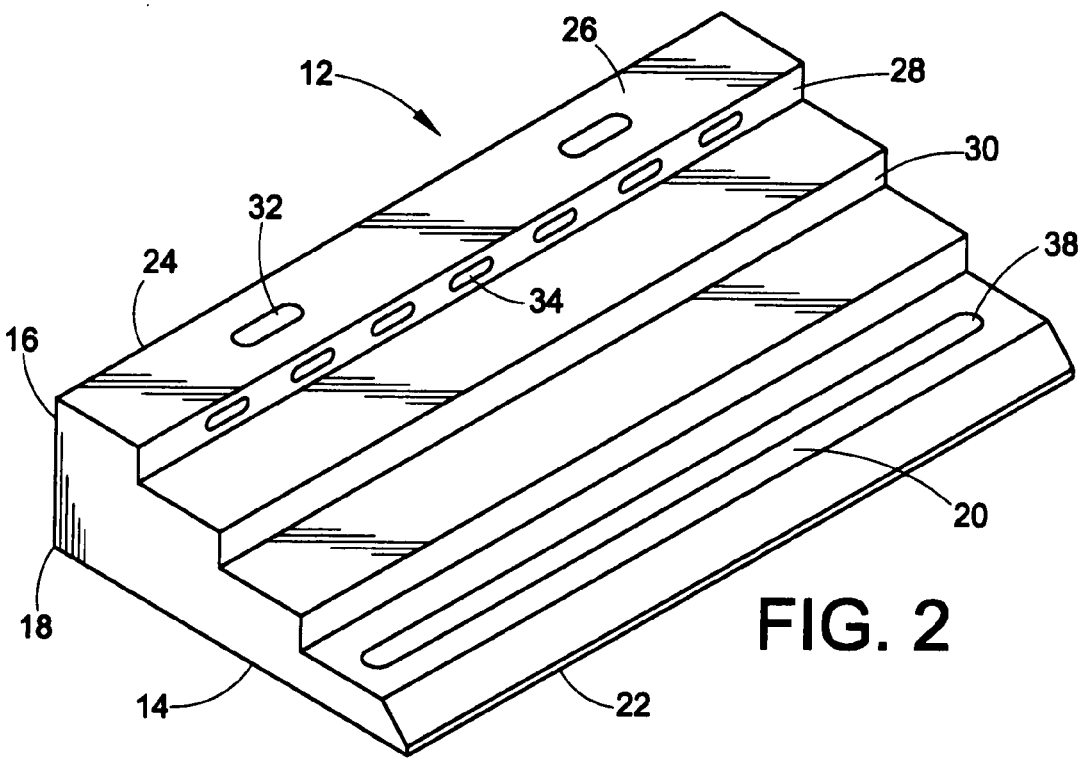
FIG. 2 shows a perspective view from the front of an edge indicator in accordance with a first embodiment of the present invention.
Figure 3:
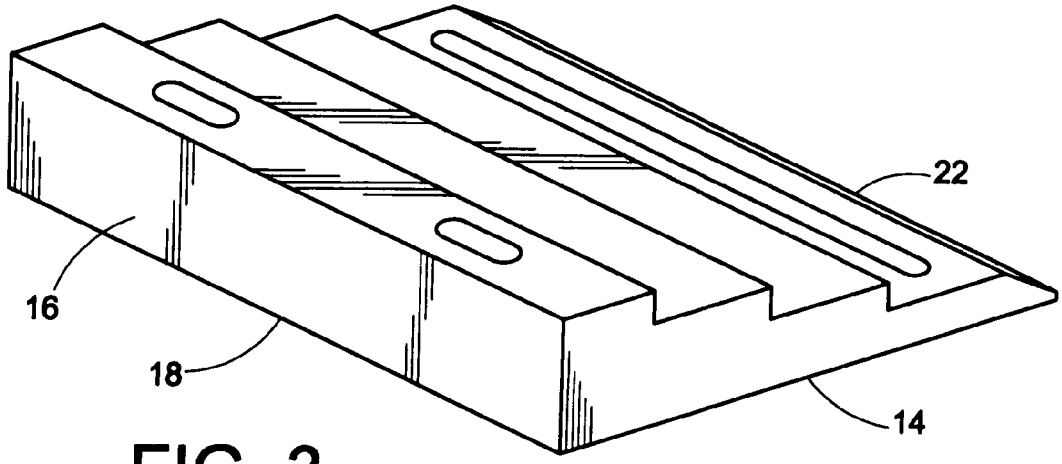
Figure 4:
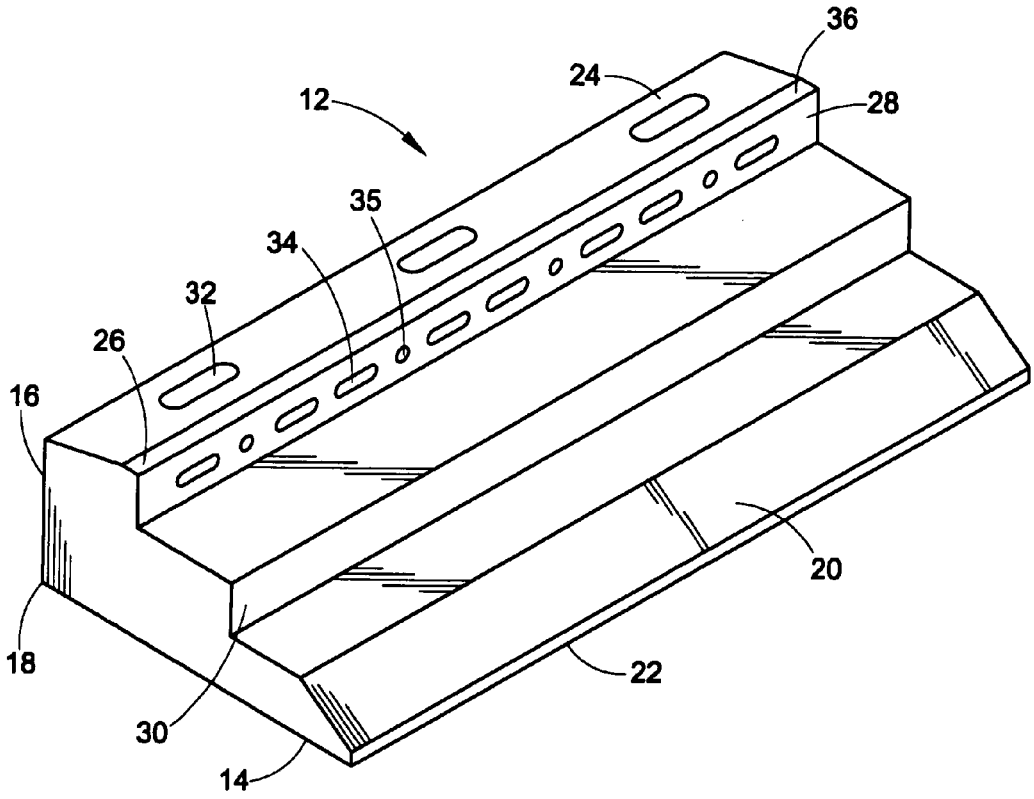
Figure 5:
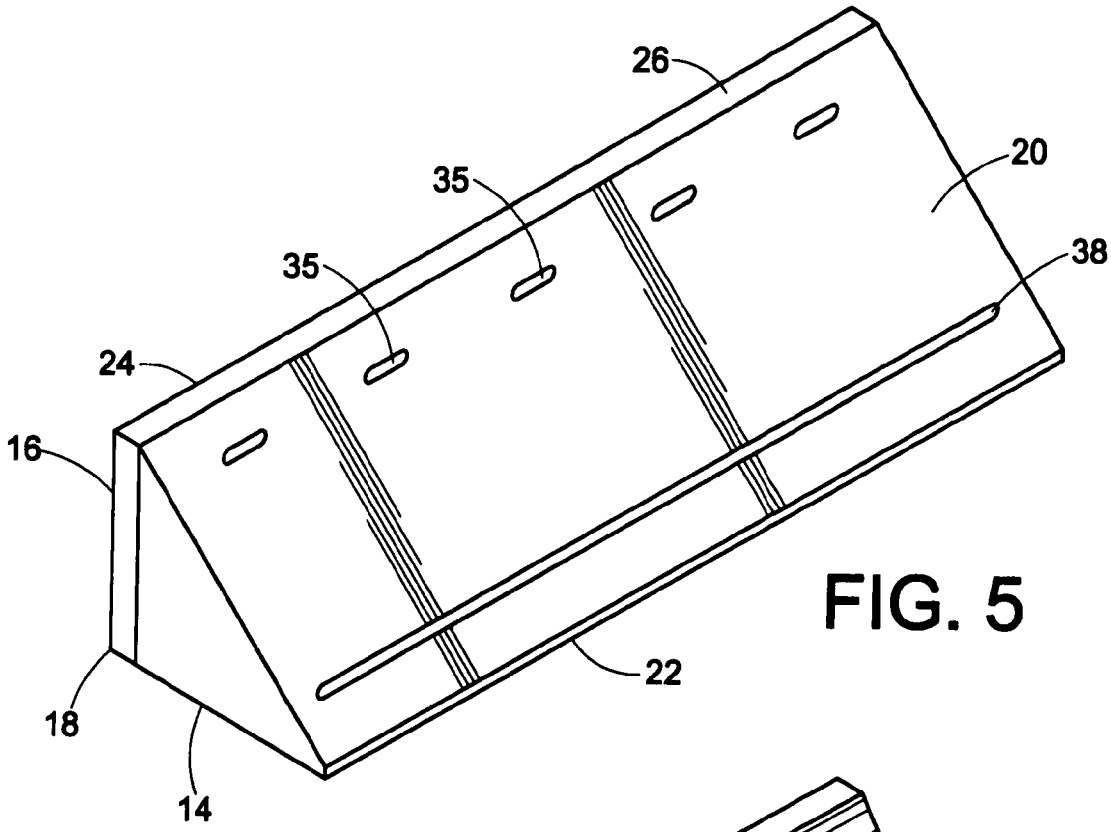
Figure 6:
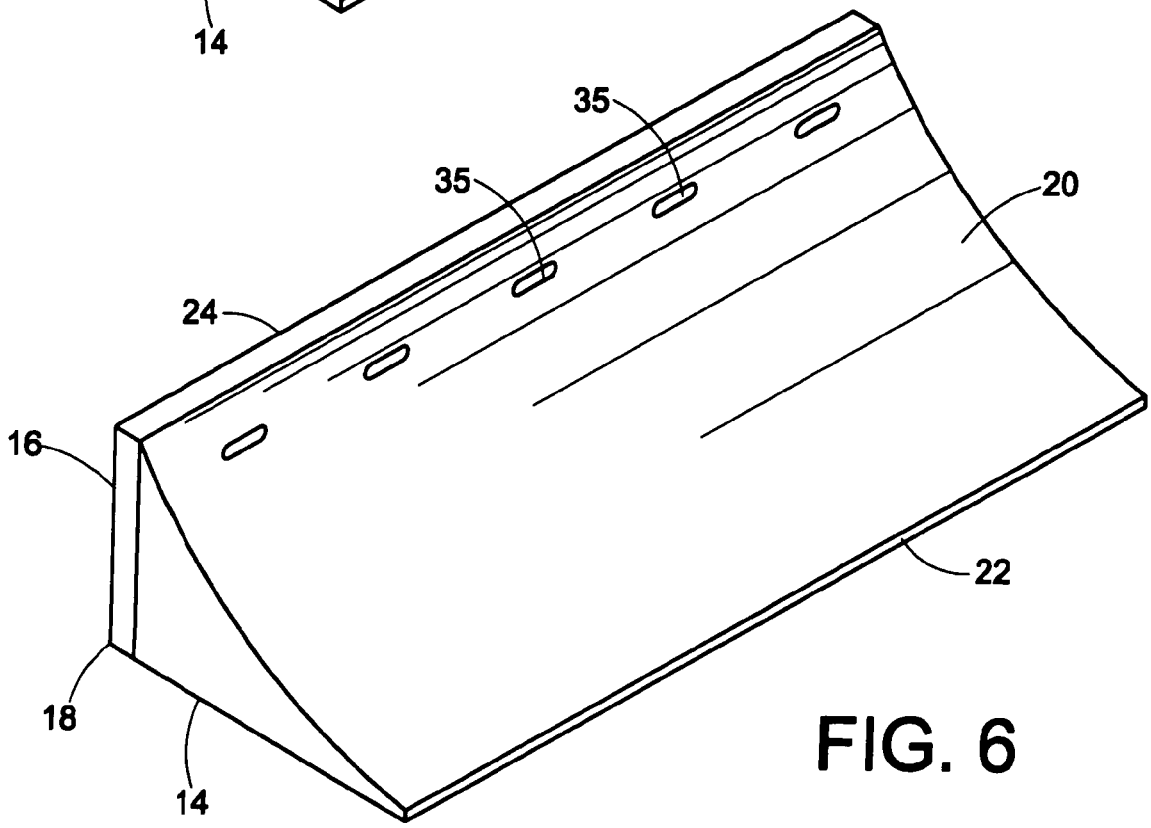
Figure 7:
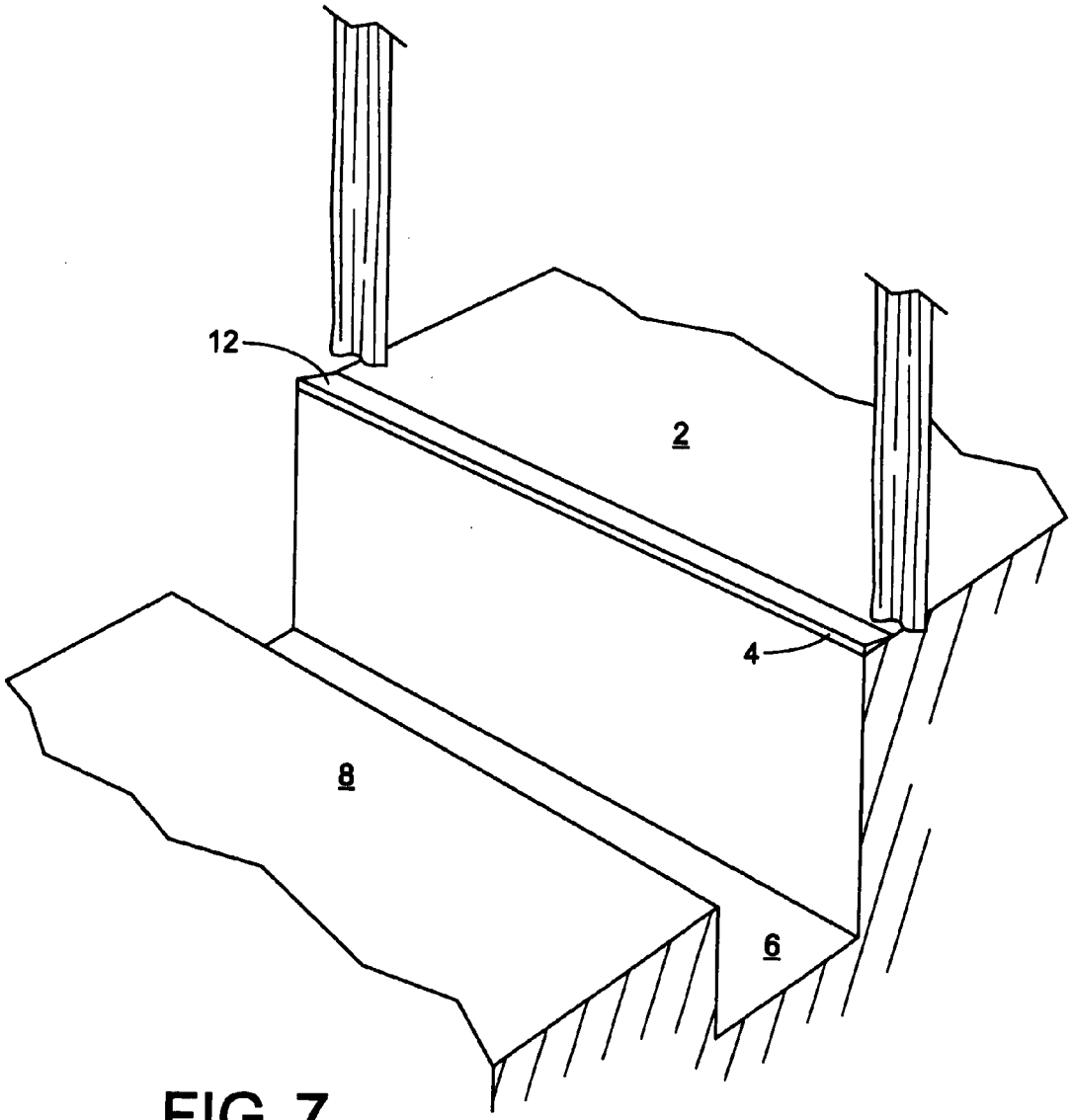
Figure 8:
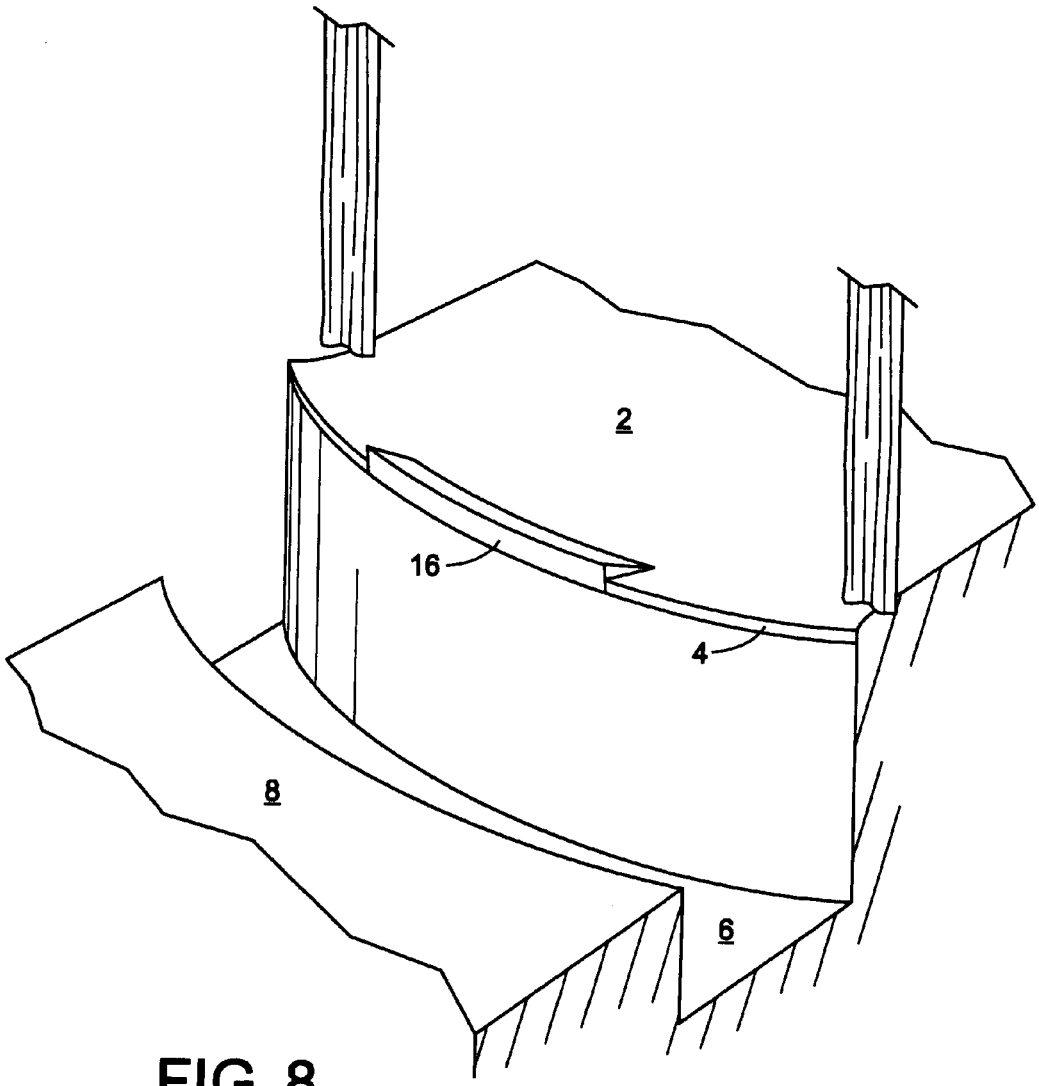
Figure 9:
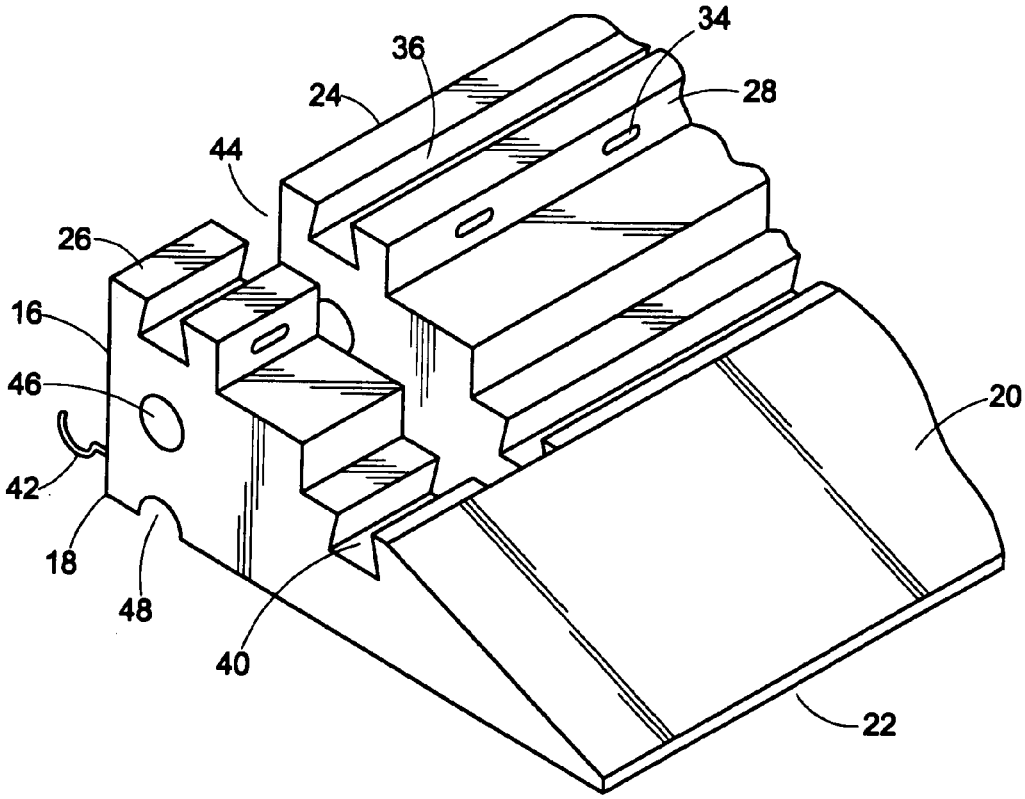

FIG. 3 shows a perspective view from the rear of the edge indicator of FIG. 2, FIG. 4 shows a perspective view from the front of an edge indicator in accordance with a second embodiment of the present invention, FIG. 5 shows a perspective view of an edge indicator from the front in accordance with a third embodiment of the present invention, FIG. 6 shows a perspective view of an edge indicator from the front in accordance with a fourth embodiment of the present invention, FIG. 7 shows a perspective view of the edge indicator of FIG. 2 applied to a stage with a straight edge, FIG. 8 shows a perspective view of an edge indicator of FIG. 2 applied to a stage with a curved edge, and FIG. 9 shows a perspective view of a detail of an indicator in accordance with a further embodiment of the invention.

Figure 1:
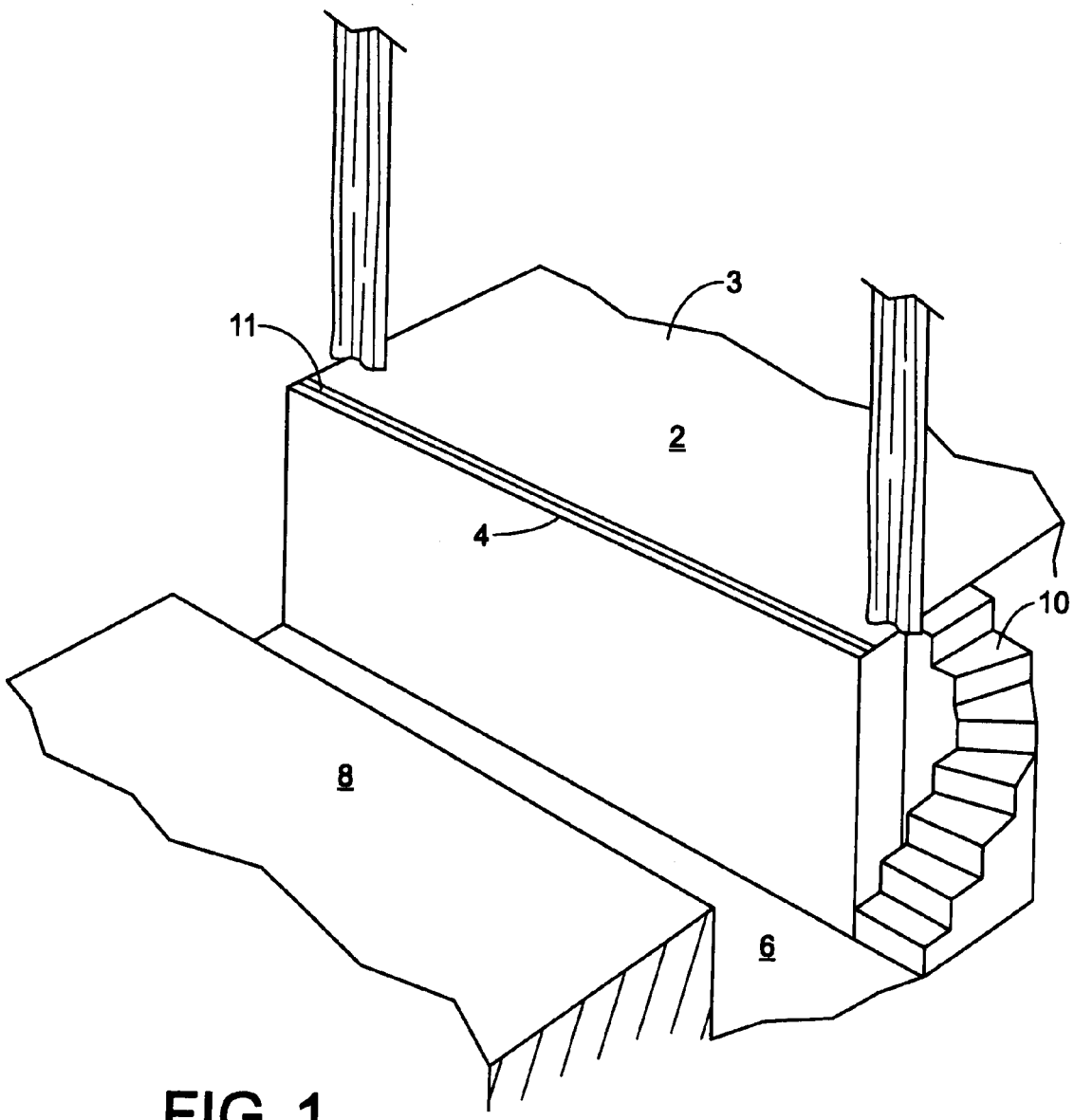
FIG. 1 (PRIOR ART)
FIG. 1 shows a perspective view of a prior art edge indicator.

FIG. 1 shows an arrangement in accordance with the prior art including a stage 2 with a straight edge 4, and orchestra pit 6 adjacent the auditorium 8 with steps 10 leading from the orchestra pit to the stage. The stage includes a portion which is inclined downwardly from the rear 3 of the stage 2 towards the edge 4 and includes a white line 11 positioned adjacent the edge 4 of the stage.

FIG. 2 shows a device in accordance with a first embodiment of the present invention comprising a wedge-shaped elongate body 12 with a broadly triangular cross section, the body including a base 14 meeting a back 16 at an edge 18, and a further side 20, opposite the edge 18, extending between the base 14 and back 16 and providing the largest side of the elongate body.

The length of the base 14, extending between the edge 18 and edge 22 at which the base meets the further side 20 is greater than the height of the back 16, extending between the edge 18 and edge 24 at which the back meets the further side 20. The height of the back 16 may be influenced, at least in part, by the depth of incline, if present, of any stage on which the device is fitted. In addition, the length of the base 14 is influenced at least in part by the need to provide a robust engagement between the device and the stage, and also by the need for the further side 20 to be sufficiently large to influence objects or people adjacent the stage edge.

The further side 20 of FIG. 2 is stepped and includes a first, top portion 26, a second portion 28 and further stepped portions 30. The top portion 26 includes means 32 to engage the body 12 with a stage, such as openings for screws or bolts or other conventional means.

Second portion 28 includes a means 34 for visually identifying the edge of the stage to individuals present on the stage. Means 34 may include for example reflection means, i.e., a known type of reflector, such that light from the lighting array, normally directed onto the stage during a performance, reflects off these reflection means and is directed back onto the stage.

The reflector means 34 may be hooded (not shown) to ensure such reflected light does not reach the audience.

On occasion lighting is dimmed or switched off during a performance, and so the second portion 28 may also include means 38 to shine light onto the stage, such light being directed, arranged and of an intensity and wavelength that no disturbance of the audience, by these means, is likely. Means 38 may also indicate the edge of the stage at other times, for example while the stage is being prepared.

The means to shine light 38 is contemplated to comprise a photoluminescent or fluorescent strip, which will glow following irradiation for a period of time, such that when the stage lights are dimmed or switched off performers may still see the strip and thereby the edge of the stage. Alternatively, such means may include bulbs and be powered by electricity.

FIG. 3 shows a rear perspective view of the elongate body of FIG. 2 showing the back 16 and edges 18 and 22. It is contemplated that the back 16 present a non-reflective surface to the auditorium being made from a black, non-reflective material or being painted black.

FIG. 4 shows a device according to a second embodiment of the present invention. A means for shining light 35 are present on portion 28 of side 20 for shining light onto the stage in the absence of reflected light from the reflecting means 34. These means for shining light may be in addition to, or alternative to, the means 38 to shine light of the first embodiment. It is contemplated that such means 35, 38 will direct low intensity light towards the stage, and be arranged, for example with hoods, such that the light is not detectable by the audience.

FIG. 5 shows a device according to a third embodiment of the present invention. The device is similar to the device of FIG. 2 except that the further surface 20 is sloped rather than being stepped.

FIG. 6 shows a device according to a fourth embodiment of the present invention. The device is similar to the device of FIGS. 2, 3 and 4 except that the further surface 20 is curved rather than being stepped or sloped.

FIG. 7 shows the device according to any one of FIGS. 2 to 6 attached to a stage with a straight edge 4.

FIG. 8 shows the device according to any one of FIGS. 2 to 6 attached to a stage with a curved edge 4.

FIG. 9 shows the device according to a further embodiment in which openings 44 are present providing access to the further surface 20 from the anchoring means 42 present on the back 16, or from the grooves 36, 48 or channel 46.

The device of any one of the embodiments described may be made from a strong, rigid material such as wood, metal, or other suitable material. Alternatively the device may be made from a flexible material such as rubber, plastics or other suitable material. For a stage with a straight edge a device made from a rigid or inflexible material may be suitable. For a stage with a curved edge a device made from a flexible material may be more suitable as the device may be urged to curve in a manner corresponding to the curved edge of the stage.

The device may be provided in a single strip of a length to cover an entire stage edge, or may be provided in sections, the sections inter-engageable such that an entire stage edge may be covered by selecting an appropriate number of sections. It is contemplated that conventional engagement means will be employed to attach such sections to each other and along the edge 4 of a stage. It is contemplated that the conventional engagement means for engaging the device with the stage may be attachable and detachable, such that the device may be attached and detached as desired.

In use, a device according to any one of the embodiments of the present invention may be selected for placement on an edge 4 of a theatre stage 2. A device of a length suitable for the length of the stage may be selected, or a number of devices of a shorter length may be selected which will, when connected together, cover a portion, or the entire length of, the edge 4 of the stage. The, or each, device may then engage with the edge 4 of the stage by conventional means such as by bolts or screws. Alternatively such devices may be attached to a stage by other conventional means including friction, or by sliding, snapping, clipping or otherwise attaching the device to the stage or to cooperating means on the stage.

The device may be positioned on the stage with the base 14 resting against the upper surface of the stage and the back 16 facing the auditorium with edge 18 proximate edge 4 and edge 22 positioned adjacent the stage surface away from the edge 4 in the direction of the rear 3 of the stage. The surface of side 20 of the device of the present invention, when placed upon a stage, inclines in an upward direction away from the surface of a stage with the back of the device, facing the audience, obscuring some portion of the stage but of a height that is sufficiently low that substantially all of the stage is visible to all members of the audience.

As stated, a portion of the stage 2 adjacent edge 4 may include an incline such that the stage is sloped, at least in part, thereby providing any audience with as complete a view as possible of the entire stage surface and the device of the present invention also acts to indicate the stage edge while not obscuring the stage surface in this case also.

The device includes many features which are capable of alerting a person present on the stage to the position of the edge of the stage. In particular the reflecting means 34 will, when the lights above the stage are lit, reflect such light onto the stage and provide a visual barrier marking the stage edge. In addition, when the lights above the stage are not lit the means 35 or 38 for shining light may shine a light onto the stage thereby providing a visual marker of the stage edge. All means 34, 35 and 38 are arranged with hoods or other conventional means (not shown) such that light is not directed into the auditorium and few, if any, members of any audience present will be alerted to the position of the stage edge 4. Means 35, 38 for shining light may be used during a performance when the lights above the stage are dimmed or switched off, and may also be used at other times to provide a visual marker for the edge of the stage.

Thus the edge of the stage is provided, by attachment of this device, with several visual warnings relating to the position of the stage edge.

The surface of the stage adjacent the edge 4 is replaced by the surface of the side 20 of the device, this surface sloping upwardly away from the stage surface and providing a further warning to a person approaching the edge of the stage. The change in the slope of the stage alerts anyone walking adjacent the edge of the stage to the proximity of the edge.

In particular, any person present on the stage will, when approaching the edge of the stage, become aware of the upwardly sloped surface of side 20 of the device. The sensation of treading on an upwardly sloped surface, together with any additional frictional effect due to the texture of the surface, provides a valuable reminder of the proximity of the edge for the stage which may be particularly useful for a preoccupied person.

The upward slope of the surface of side 20 may also provide useful leverage for a person to push against for repositioning, stabilising or changing direction. The surface may include further features to increase the friction experienced by a person or object passing across it. For example, surface 20 may be ridged or have a serrated surface to increase the tactile effect of the sloped surface.

The particular features of the shape of the device may not be sufficient to prevent a person falling off the edge of the stage, but may be enough to allow the person to prepare for the fall and reduce the ultimate damage.

With the device attached to a stage while the stage is being prepared for a performance, or during a performance, any item which rolls, slides or slips along the sloped stage surface towards the edge 4 will encounter the upwardly sloped surface of the side 20 of the device and will, due to the resistance thereby provided by gravity and/or the friction of the surface, be discouraged from falling off the edge 4.

Particular advantages of the present invention are that the device provides a warning of the proximity of the edge of a stage such that people may take steps to protect themselves or objects from the danger of a fall off the edge of the stage while not adversely affecting the view the audience has of the stage. In addition the device does not need a power source, as it has no power requirements, and includes no trailing wires to clutter a stage.

Much of the work done on stage, either by performers or by those preparing the stage for use, will require power, and so cables, wires and other items will be present. Such items are often distributed at random over the stage providing a further danger.

The present invention may additionally provide means to anchor such items and also protect such items from damage or from causing an obstruction or danger.

In addition to the features already discussed in relation to FIG. 4, FIG. 4 further shows a channel 36 in the top surface 26 of the device, which is provided, according to a second embodiment, for anchoring purposes. Cables, wires and such items can be secured within the channel, enhancing the safety of the stage environment.

FIG. 9 shows several alternative means for securing trailing wires and other items to the device. In particular, a groove 40 similar to the groove in FIG. 4 is positioned on further surface 20. Alternatively a tube 46 is shown extending along the length of the device adjacent the back 16, and in addition, a further groove 48 is also shown positioned on the base 14 of the device.

Each groove may be cylindrical, or may be shaped to urge any wire or cable within the groove to remain within the groove. Grooves 36, 40 in the top surface 20 of the device of FIG. 9 have narrow top openings and extend to provide a wider volume for holding a cable or wire, such that the cable may be urged through the open top and rest adjacent the wider base of such a groove. The narrow opening and large internal cavity encourages any such wire to remain within such a groove.

For larger, heavier, cables or large groups of cables, hooks or other retaining means 42 may be positioned along the back 16 of the device. Such large cables or groups of cables often includes cabling to which access is required from different portions of the stage, and so FIG. 9 shows openings 44 in the device through which such cabling may be accessed from the stage.

With hooks or retaining devices 42 attached to the device the device may need to be positioned slightly inwardly of the edge of the stage.

The top 26 may also include further means to protect the edge of the stage, including for example provision to attach a physical barrier at the edge of the stage, such as a fence (not shown). Such a fence may be anchored to the device at the top surface 26 and may extend along the entire edge of the stage. The strength of the fence may vary and may be removable and will provide a further visible indication of the edge of the stage.

The strip of the present invention may also include means, not shown, to further obscure or cover the means 34, 35, 38 for shining or directing light onto the stage, thereby preventing an audience being distracted at dramatic moments by such light.

It will be appreciated that the present invention is not restricted to the details of the foregoing embodiments. In particular while the present invention has been described in relation to stages for performances, it is contemplated that such items may be suitable for other types of edges where it is not possible to erect a permanent barrier or fence, such as for example railway platforms or other suitable edges. The device may not necessarily be wedge-shaped or have a triangular cross-section, but may include any suitable shape or cross section. In addition, surface 20 may be sloped, and may further be curved in a concave or convex manner. The device is suitable for positioning on a stage adjacent the edge 4 which includes a position close to as well as directly against the edge 4. Means 34, 35 and 38 may be positioned anywhere on the surface of the side 20. Means 38 may include bulbs and be powered by electricity. The length of the base may not necessarily be greater than the height of the back. Means 35, 38 may act when reflecting means 34 are not operative, but may also act when reflecting means 34 are operative.

The invention claimed is:

1. An edge indicator device for an associated stage including an elongate strip for indicating an edge of the associated stage comprising:

a base for resting on the associated stage;

a back;

a further surface extending upwardly away from a plane defining a surface of the associated stage;

wherein with the device resting on the associated stage, said further surface takes the place of the associated stage surface and includes an indication means to indicate an edge of the associated stage and wherein the elongate strip is significantly wider than it is high.

2. An edge indicator according to claim 1 wherein said elongate strip is wedge-shaped.

3. An edge indicator according to claim 2 wherein the long surface of the wedge is sloped, ridged or stepped.

4. An edge indicator according to claim 1 wherein said strip includes attachment means for attaching the device to the associated stage.

5. An edge indicator according to claim 4 wherein said attachment means is a detachable attachment means.

6. An edge indicator according to claim 1 wherein said indication means includes reflecting means which is screened from an audience located adjacent the associated stage via means to restrict said reflected light to shine only onto the associated stage.

7. An edge indicator according to claim 1 wherein said indication means includes a light emitting means which is screened from the audience located adjacent the associated stage via means to restrict said emitted light to shine only onto the associated stage.

8. An edge indicator according to claim 7 wherein in said light emitting means comprise a fluorescent strip.

9. An edge indicator according to claim 8 wherein said light emitting means comprise a photoluminescent strip.

10. An edge indicator according to claim 1 further including anchoring means to anchor associated items to said strip.

11. An edge indicator according to claim 10 wherein said anchoring means includes a groove in a surface of the strip, said groove extending parallel to a longitudinal axis of said strip, or a tube running through said strip.

12. An edge indicator according to claim 11 in which said grooves are shaped to releasably retain such cabling, wiring or ropes within said grooves.

13. An edge indicator according to claim 10 wherein with said anchoring means attached to said back of the strip, openings are positioned along the strip for said items to access said further surface.

14. An edge indicator according to claim 10 wherein said anchoring means includes a channel extending parallel to a longitudinal axis of said strip, and the associated items include elongated objects, such as cables, wires or rope which are accommodated in said channel.

15. An edge indicator according to claim 1 wherein with the indicator positioned on a sloped associated stage, said back is dimensioned such that the top surface of the device is below the portion of the associated stage remote from the device.

16. An edge indicator according to claim 1 in which said further surface includes means to attach a barrier.

17. An edge indicator for an associate stage for indicating an edge of the associated stage, comprising:

an elongated strip supported on the associated stage, comprising:

a base surface for resting on a surface of the associated stage, a back surface, a further surface sloping upwardly away from a plane of the surface of the associated stage, wherein with said strip being supported on the associated stage said further surface takes the place of the associated stage, and an indication means for indicating an edge of the associated stage, said indication means being supported by said further surface, wherein the elongated strip is significantly wider than it is high.

18. The edge indicator of claim 17 wherein said indication means comprises at least one of a light reflector and a light emitting member.

19. The edge indicator of claim 18 wherein said further surface includes a friction element to serve as an alert with regard to the proximity of the edge of the associated stage.

20. An edge indicator for indicating an edge of an associated stage, comprising:

a base for resting on the associated stage;

a back;

an edge at which said base meets said back;

a further surface located opposite said edge, said further surface extending between said base and said back and providing a largest side of the edge indicator, wherein said further surface extends upwardly away from a plane defining a surface of the associated stage to indicate an edge of the associated stage and wherein the edge indicator is significantly wider than it is high.

21. The edge indicator of claim 20 further comprising a channel or groove, extending parallel to a longitudinal axis of the edge indicator, for accommodating elongated objects, such as cables, wires or rope.

* * * * *